US011840677B2

(12) United States Patent
Kim

(10) Patent No.: US 11,840,677 B2
(45) Date of Patent: Dec. 12, 2023

(54) LUBRICANT COMPOSITION HAVING IMPROVED HIGH-TEMPERATURE DURABILITY

(71) Applicants: HYUNDAI MOTOR COMPANY, Seoul (KR); KIA MOTORS CORPORATION, Seoul (KR)

(72) Inventor: Jae Hyeon Kim, Geoje-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/692,765

(22) Filed: Mar. 11, 2022

(65) Prior Publication Data

US 2022/0195324 A1 Jun. 23, 2022

Related U.S. Application Data

(62) Division of application No. 16/913,220, filed on Jun. 26, 2020, now Pat. No. 11,299,689.

(30) Foreign Application Priority Data

Aug. 27, 2019 (KR) ..... 10-2019-0105166

(51) Int. Cl.
*C10M 117/04* (2006.01)
*C10M 113/08* (2006.01)
(Continued)

(52) U.S. Cl.
CPC ..... *C10M 117/04* (2013.01); *C10M 107/02* (2013.01); *C10M 113/08* (2013.01);
(Continued)

(58) Field of Classification Search
CPC ..... C10M 117/04; C10M 113/08; C10M 115/02; C10M 117/06; C10M 119/02;
(Continued)

(56) References Cited

U.S. PATENT DOCUMENTS 2,320,002 A 5/1943 Pool
2,836,562 A 5/1958 Ambrose
(Continued)

FOREIGN PATENT DOCUMENTS

CN 1578825 A 2/2005
CN 1580214 A 2/2005
(Continued)

OTHER PUBLICATIONS

U.S. Notice of Allowance dated Dec. 8, 2021 issued in U.S. Appl. No. 16/913,220.
(Continued)

*Primary Examiner* — Cephia D Toomer
(74) *Attorney, Agent, or Firm* — Morgan, Lewis & Bockius LLP

(57) ABSTRACT

The present disclosure relates to a lubricant composition including a base oil, a thickener and a thickener supplement, and a method of manufacturing the same. The lubricant composition of the present disclosure is effective at improving performance at high-temperature by maintaining the evaporation amount and friction characteristics even at high temperatures, thus inhibiting oil contamination of powertrain parts and the like and maintaining sticking phenomenon even in a high-temperature environment, thereby increasing the durability of parts.

7 Claims, 3 Drawing Sheets

(51) Int. Cl.

| | |
|---|---|
| ***C10M 115/02*** | (2006.01) |
| ***C10M 117/06*** | (2006.01) |
| ***C10M 119/02*** | (2006.01) |
| ***C10M 169/02*** | (2006.01) |
| ***C10M 169/04*** | (2006.01) |
| ***C10M 107/02*** | (2006.01) |
| *C10N 70/00* | (2006.01) |
| *C10N 10/02* | (2006.01) |
| *C10N 10/04* | (2006.01) |
| *C10N 20/02* | (2006.01) |
| *C10N 30/12* | (2006.01) |
| *C10N 30/10* | (2006.01) |
| *C10N 30/08* | (2006.01) |
| *C10N 30/06* | (2006.01) |
| *C10N 40/04* | (2006.01) |

(52) U.S. Cl.
CPC ..... *C10M 115/02* (2013.01); *C10M 117/06* (2013.01); *C10M 119/02* (2013.01); *C10M 169/02* (2013.01); *C10M 169/042* (2013.01); *C10M 2201/062* (2013.01); *C10M 2205/003* (2013.01); *C10M 2205/024* (2013.01); *C10M 2205/186* (2013.01); *C10M 2207/1206* (2013.01); *C10M 2207/1236* (2013.01); *C10M 2207/1245* (2013.01); *C10N 2010/02* (2013.01); *C10N 2010/04* (2013.01); *C10N 2020/02* (2013.01); *C10N 2030/06* (2013.01); *C10N 2030/08* (2013.01); *C10N 2030/10* (2013.01); *C10N 2030/12* (2013.01); *C10N 2040/04* (2013.01); *C10N 2070/00* (2013.01)

(58) Field of Classification Search
CPC ..... C10M 169/02; C10M 169/042; C10M 107/02; C10M 2201/062; C10M 2205/024; C10M 2205/003; C10M 2205/186; C10M 2207/1206; C10M 2207/1236; C10M 2207/1245; C10N 2070/00; C10N 2010/02; C10N 2010/04; C10N 2020/02; C10N 2030/12; C10N 2030/10; C10N 2030/08; C10N 2030/06; C10N 2040/04
See application file for complete search history.

(56) References Cited

U.S. PATENT DOCUMENTS

| | | | | |
|---|---|---|---|---|
| 5,000,862 | A | 3/1991 | Waynick | |
| 5,096,605 | A | 3/1992 | Waynick | |
| 11,299,689 | B2 * | 4/2022 | Kim | C10M 119/02 |
| 2003/0207971 | A1 | 11/2003 | Stuart, Jr. et al. | |

FOREIGN PATENT DOCUMENTS

| | | | | |
|---|---|---|---|---|
| CN | 104450006 | A | | 3/2015 |
| CN | 106520255 | A | | 3/2017 |
| EP | 0134063 | | * | 3/1985 |
| EP | 0700986 | | * | 3/1996 |
| FR | 1070850 | A | | 8/1954 |
| GB | 799465 | A | | 8/1985 |
| JP | 2000230188 | | * | 8/2000 |
| KR | 10-2002-0075958 | A | | 10/2002 |
| SU | 1395657 | | * | 5/1988 |
| WO | 2010/017909 | A1 | | 2/2010 |

OTHER PUBLICATIONS

Final Office Action dated Sep. 21, 2021 issued in U.S. Appl. No. 16/913,220.

Non-Final Office Action dated Apr. 13, 2021 issued in U.S. Appl. No. 16/913,220.

Umarov, et al., "Effects of Lubricating Greases on Abrasive Wear of Friction Surfaces," 1986, Plenum Publishing Corp, pp. 245-247, Year 1986.

* cited by examiner

LUBRICANT COMPOSITION HAVING IMPROVED HIGH-TEMPERATURE DURABILITY

CROSS-REFERENCE TO RELATED APPLICATION

This application claims priority to and the benefit of Korean Patent Application No. 10-2019-0105166, filed on Aug. 27, 2019, which is incorporated herein by reference in its entirety.

FIELD

The present disclosure relates to a lubricant composition and a method of manufacturing the same.

BACKGROUND

The statements in this section merely provide background information related to the present disclosure and may not constitute prior art.

Grease is a sticky lubricant in which soap is mixed in mineral oil, and, compared to liquid lubricant, is characterized by low leakage, strong adsorption capability and self-sealing function, thereby making penetration of dust, water, solid matter, gas, etc. therein difficult. Hence, grease is mainly used when there is a concern of loss due to leakage or when there is a concern of contact with dust or corrosive gas. In particular, grease is widely used as a lubricant for various friction parts that may be contaminated by oil, and is applied to all fields of transportation machinery such as vehicles, aircraft, ships, facility machinery for steelmaking and papermaking, construction machinery, electrical equipment, and the like. Due to the high performance, downsizing, and high efficiency of various kinds of machinery and equipment, the temperatures the powertrain parts are required to withstand are increasing. Accordingly, grease is required to operate under harsh conditions such as high temperatures and high loads, and the kinds of grease and characteristics required thereof are also becoming increasingly diverse.

When conventional grease is used in a setting that must withstand high temperature for a long period of time, the oil separates, evaporates, and hardens, which leads to a sticking phenomenon. Excessive oil separation causes electrical malfunction due to contamination of parts or inflow into the motor or switch board. In the case of a sticking phenomenon, the lack of lubrication results in operation noise of parts or gears that are unable to function.

Therefore, it is desirable to develop a lubricant composition for increasing durability such that it inhibits powertrain parts and the like from being contaminated by oil and is inhibited from sticking even under harsh conditions such as high temperatures and high loads.

SUMMARY

The present disclosure provides a lubricant composition, which is capable of maintaining an evaporation amount and friction characteristics of powertrain parts even under high-temperature and high-load conditions, and a method of manufacturing the same.

The present disclosure provides a lubricant composition, including a base oil, a thickener, and a thickener supplement.

The lubricant composition may include 60 to 90 wt % of the base oil, 5 to 35 wt % of the thickener, and 2 to 7 wt % of the thickener supplement.

The base oil may be polyalphaolefin (PAO) having a viscosity of 50 to 400 cSt at 40° C.

The thickener may include a metal compound and at least one main acid or sub acid.

The main acid may be at least one of 12-hydroxystearic acid or stearic acid.

The sub acid may be at least one of azelaic acid, lauric acid, myristic acid, sebacic acid, or palmitic acid.

The metal may be at least one of lithium or calcium.

The thickener supplement may be at least one of polypropylene or ceresin.

The thickener supplement may be configured such that a polypropylene/ceresin ratio (P/C ratio) is 0.40 to 2.35.

The lubricant composition may further include 0.1 to 3 wt % of an additive.

The additive may be at least one of a Zn-based antioxidant or a Ba-based corrosion inhibitor.

The present disclosure provides a method of manufacturing a lubricant composition, which includes: heating a base oil, obtaining a solution by adding and reacting the heated base oil with a thickener, dewatering the reacted solution, adding the dewatered solution with a thickener supplement, and stirring the dewatered solution added with the thickener supplement.

Obtaining the solution by adding and reacting the heated base oil with the thickener may include obtaining a solution by dissolving at least one main acid or a sub acid in the heated base oil, adding a metal compound to the solution, and heating the solution with the metal compound to cause a reaction.

The metal compound may be at least one of Li-hydroxide or Ca-hydroxide.

Adding the dewatered solution with the thickener supplement may be performed in a manner in which at least one of polypropylene and ceresin is added while the dewatered solution cools.

Adding the dewatered solution with the thickener supplement may be performed in a manner in which polypropylene is dissolved in base oil at 140 to 160° C. and stirred to prepare a polypropylene solution, which is then added to the cooled solution.

The polypropylene solution may be added when the temperature of the cooled solution is 140 to 160° C.

Adding the dewatered solution with the thickener supplement may be performed in a manner in which ceresin is added when the temperature of the cooled solution is 75 to 95° C.

An additive may be further added when the ceresin is added.

The lubricant composition may include 60 to 90 wt % of the base oil, 5 to 35 wt % of the thickener, and 2 to 7 wt % of the thickener supplement.

According to the present disclosure, a lubricant composition is effective at improving performance at high-temperature by maintaining the evaporation amount and friction characteristics even at high temperatures, thus inhibiting oil contamination of powertrain parts and the like and the sticking phenomenon even in a high-temperature environment, thereby increasing the durability of parts.

The effects of the present disclosure are not limited to the foregoing, and should be understood to include all effects that can be reasonably anticipated from the following description.

Further areas of applicability will become apparent from the description provided herein. It should be understood that the description and specific examples are intended for purposes of illustration only and are not intended to limit the scope of the present disclosure.

DRAWINGS

To better understand the disclosure, various forms will now be described, given by way of example, with references being made to the accompanying drawings, in which.

Figure 1:
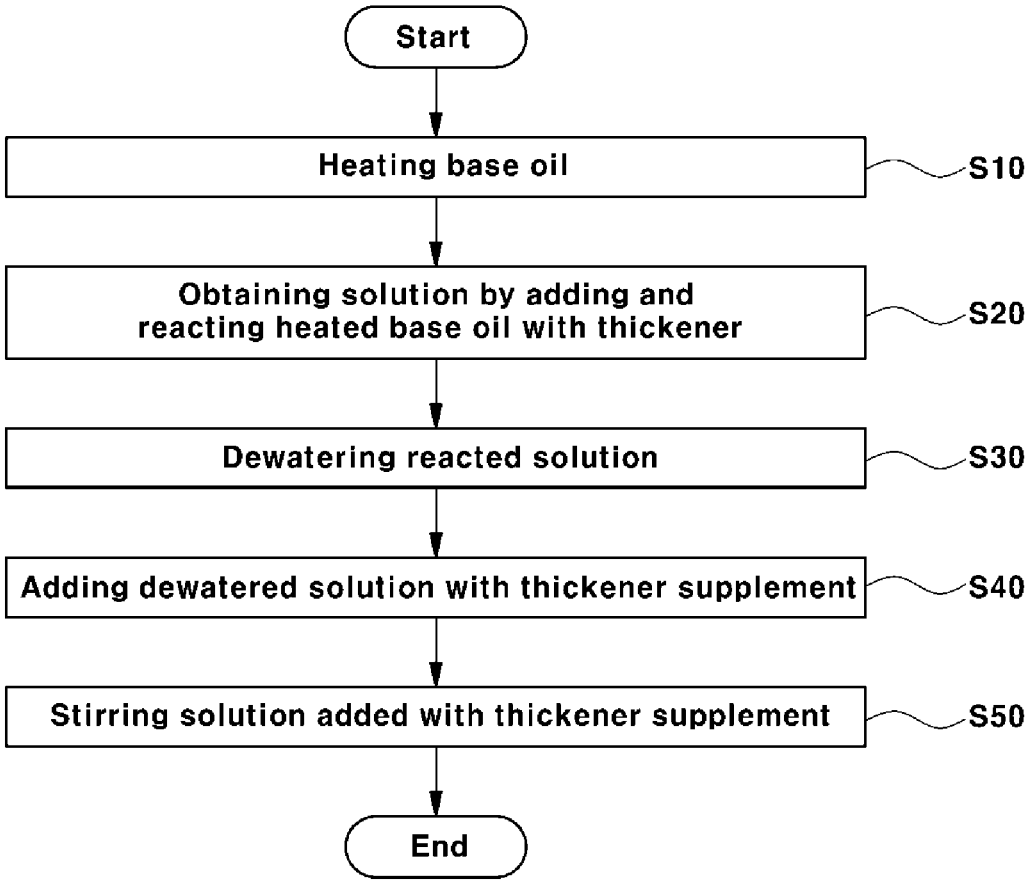
FIG. 1 is a flowchart showing a process of manufacturing a lubricant composition according to the present disclosure.
Figure 2:
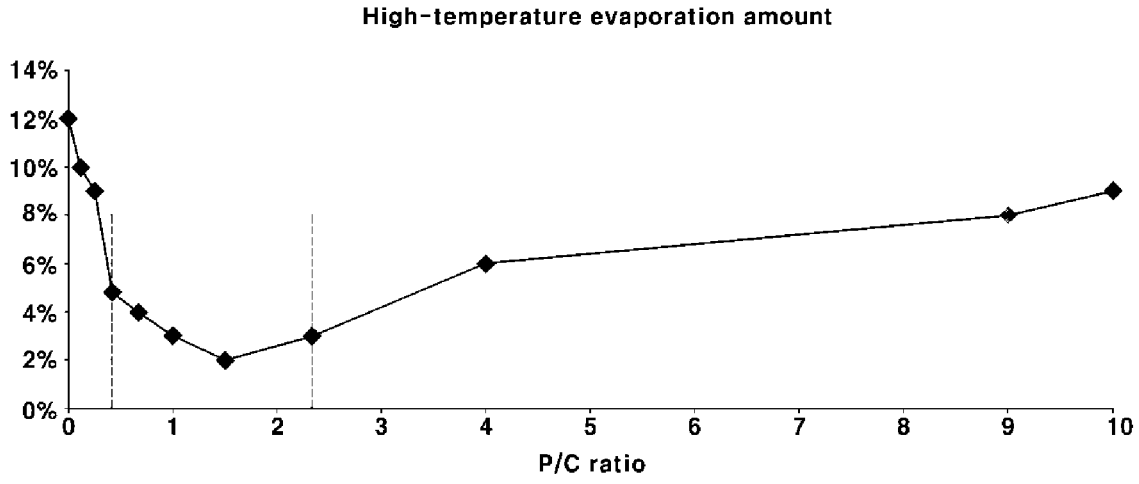
FIG. 2 is a graph showing a high-temperature evaporation amount of 5 wt % or less at a P/C ratio ranging from 0.40 to 2.35.
Figure 3:
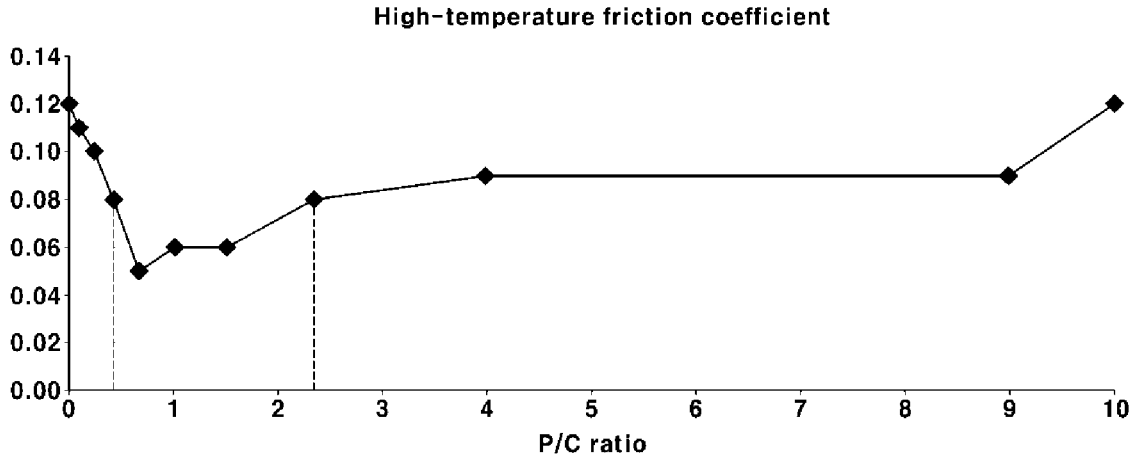
FIG. 3 is a graph showing a high-temperature friction coefficient of 0.08 or less at a P/C ratio ranging from 0.40 to 2.35.
Figure 4:
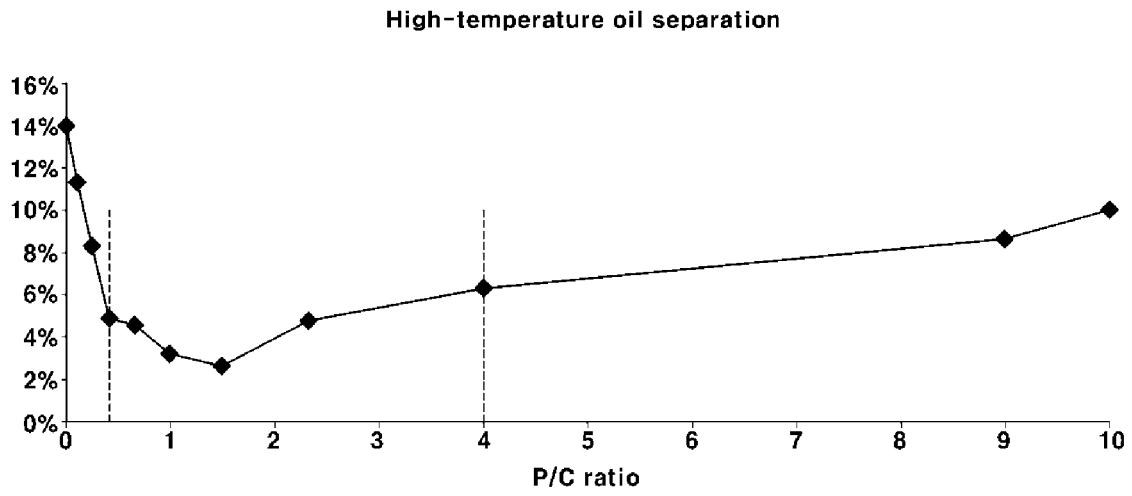
FIG. 4 is a graph showing high-temperature oil separation of 5 wt % or less at a P/C ratio ranging from 0.40 to 2.35.
Figure 5:
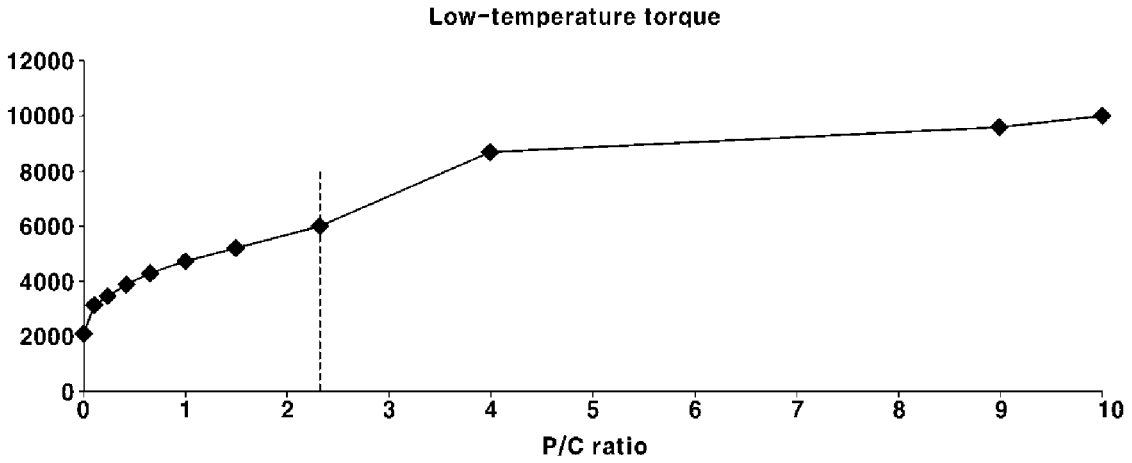
FIG. 5 is a graph showing low-temperature torque of about 6000 or less at a P/C ratio ranging from 0.40 to 2.35.

The drawings described herein are for illustration purposes only and are not intended to limit the scope of the present disclosure in any way.

DETAILED DESCRIPTION

The features and advantages of the present disclosure will be more clearly understood from the following forms taken in conjunction with the accompanying drawings. The present disclosure is not limited to the forms disclosed herein, and may be modified into different forms. These forms are provided to thoroughly explain the present disclosure and to sufficiently transfer the spirit of the present disclosure to those skilled in the art. It should be understood that throughout the drawings, corresponding reference numerals indicate like or corresponding parts and features.

It will be understood that the terms "comprise", "include", "have", etc., when used in this specification, specify the presence of stated features, integers, steps, operations, elements, components, or combinations thereof, but do not preclude the presence or addition of one or more other features, integers, steps, operations, elements, components, or combinations thereof.

Unless otherwise specified, all numbers, values, and/or representations that express the amounts of components, reaction conditions, polymer compositions, and mixtures used herein are to be taken as approximations including various uncertainties affecting the measurements that essentially occur in obtaining these values, among others, and thus should be understood to be modified by the term "about" in all cases. Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated.

According to one form of the present disclosure, a lubricant composition includes base oil, a thickener and a thickener supplement, and may further include an additive.

Preferably, the lubricant composition includes 60 to 90 wt % of the base oil, 5 to 35 wt % of the thickener and 2 to 7 wt % of the thickener supplement, and further includes 0.1 to 3 wt % of the additive.

The amount of each component of the lubricant composition, which will be described below, is represented based on 100 wt % of the lubricant composition. If the amount basis thereof is changed, the new basis will always be set forth so that a person skilled in the art will clearly know the basis on which the amount is described.

(1) Base Oil

According to one form of the present disclosure, the base oil in the lubricant composition is the desired material of the lubricant composition, and is not limited, so long as there is no particular problem when manufacturing the lubricant composition according to the present disclosure.

In one form of the present disclosure, the base oil may be mineral oil, which is distilled, separated and refined from crude oil, or may be synthetic oil manufactured through a synthesis process. The base oil used in the present disclosure is synthetic oil that may withstand high temperatures and high loads and has extended relubrication cycles, examples of which may include polyalphaolefin (PAO), polyglycol (PAG) and ester oil (ES). Preferably, the base oil used in the present disclosure is polyalphaolefin (PAO) having a viscosity of 50 to 400 cSt at 40° C.

In another form of the present disclosure, the amount of the base oil may be 60 to 90 wt % based on 100 wt % of the lubricant composition. If the amount thereof is less than 60 wt %, it is difficult to form a stable structure due to dispersion in the thickener and it is difficult to manufacture a lubricant composition because of the problem of worked penetration. On the other hand, if the amount thereof exceeds 90 wt %, the resulting lubricant composition will be diluted and may flow down and worked penetration and worked stability may become problematic.

(2) Thickener

According to one form of the present disclosure, the thickener in the lubricant composition is a solid that is affinitive to the base oil, and is not limited so long as it is finely dispersed in the base oil to form a stable three-dimensional structure for improving heat resistance, water resistance, mechanical stability and vibration resistance of the lubricant composition.

In another form of the present disclosure, examples of the thickener may include simple soap such as calcium soap, sodium soap, lithium soap, etc., complex soap such as lithium complex soap, calcium complex soap, aluminum complex soap, etc., and non-soap such as urea, silica gel, etc. Preferably, complex soap is useful as it may withstand high temperatures and high loads and has superior water resistance, load resistance and mechanical stability. Even more preferable is lithium complex soap.

In another form of the present disclosure, the thickener may include a metal along with at least one of a main acid or a sub acid. The metal may be at least one of lithium or calcium. The main acid may be at least one of 12-hydroxystearic acid or stearic acid, and the sub acid may be at least one of azelaic acid, lauric acid, myristic acid, sebacic acid, or palmitic acid.

In another form of the present disclosure, the amount of the thickener may be 5 to 35 wt %. If the amount thereof is less than 5 wt %, there is a risk of oil separation at high temperatures and leakage because the lubricant composition is dilute and may flow down. On the other hand, if the amount thereof exceeds 35 wt %, low-temperature fluidity may decrease and torque may increase.

(3) Thickener Supplement

According to one form of the present disclosure, the thickener supplement in the lubricant composition is a material to supplement the thickener for improving the performance of the lubricant composition, such as the heat resistance, water resistance, mechanical stability and vibration resistance thereof, and is not limited unless it destroys the structure of the thickener and thereby causes softening of the lubricant composition.

In another form of the present disclosure, the thickener supplement may be at least one of polypropylene or ceresin for improving the performance of the lubricant composition at high-temperature and for inhibiting oil separation of the lubricant composition at high temperatures. Here, polypropylene may have a melting point of 130 to 140° C. and ceresin may have a melting point of 60 to 65° C.

In another form of the present disclosure, the amount of the thickener supplement may be 2 to 7 wt %. If the amount thereof is less than 2 wt %, there is a risk of oil separation at high temperatures. On the other hand, if the amount thereof exceeds 7 wt %, the lubricant composition may agglomerate and the fluidity of the lubricant composition may decrease at low temperatures, making it impossible to measure the low-temperature torque.

In another form of the present disclosure, the polypropylene/ceresin ratio (P/C ratio) may fall in the range of 0.40 to 2.35, and particularly 0.43 to 2.33. If the P/C ratio falls out of the above range, the evaporation amount may increase and friction characteristics cannot be maintained, undesirably deteriorating the improvement in the lubricant composition's performance at high-temperature.

In another form of the present disclosure, polypropylene and ceresin are added in the form of a powder, and the size thereof may fall in the range of 0.1 μm to 1 μm. If the size thereof exceeds 1 μm, agglomeration may occur and thus efficient production may become difficult.

(4) Additive

According to one form of the present disclosure, the additive in the lubricant composition is not limited so long as it improves various other properties of the lubricant composition.

In another form of the present disclosure, the additive may include an antioxidant, a corrosion inhibitor, a rust inhibitor, an extreme pressure agent, an anti-wear agent, an adhesion enhancer, and the like, and is at least one of a Zn-based antioxidant or a Ba-based corrosion inhibitor.

In another form of the present disclosure, the amount of the additive may be 0.1 to 3 wt %. If the amount thereof falls out of the above range, grease may be oxidized at high temperatures, which may lead to performance deterioration and part corrosion. If the amount thereof exceeds 3 wt %, there are no improvement effects.

FIG. 1 is a flowchart showing the process of manufacturing the lubricant composition according to one form of the present disclosure. With reference thereto, the method of manufacturing the lubricant composition may include heating a base oil (S10), obtaining a solution by adding and reacting the heated base oil with a thickener (S20), dewatering the reacted solution (S30), adding the dewatered solution with a thickener supplement (S40), and stirring the solution added with the thickener supplement (S50). When ceresin, included in the thickener supplement, is added, an additive may be further added.

In the phase of heating the base oil (S10), the base oil is heated to dissolve the acid contained in the thickener. The base oil may be heated to a temperature of 70 to 90° C., and particularly 80° C.

In the phase of obtaining the solution by adding and reacting the base oil with the thickener (S20), the acid component is dissolved in the heated base oil and a metal compound is then added thereto to cause saponification, thereby obtaining a reaction solution.

Specifically, the heated base oil is added with at least one main acid or sub acid to afford a solution, which is then added with a metal compound, and further heated and reacted. Here, the reaction heating temperature may be 80 to 125° C.

The main acid is at least one of 12-hydroxystearic acid or stearic acid, and the sub acid is at least one of azelaic acid, lauric acid, myristic acid, sebacic acid or palmitic acid. The metal compound is at least one of Li-hydroxide or Ca-hydroxide.

In the phase of dewatering the reaction solution (S30), the reaction solution is heated and stirred to remove water generated from the reaction and to uniformly disperse the reaction solution and the base oil. Unless heating and stirring are performed under appropriate temperature and time conditions, uniform dispersion cannot result, and water may be left behind to give a soft lubricant composition, undesirably facilitating separation of the base oil. Hence, according to the present disclosure, the heating and stirring may be performed at 180° C. or higher for 1.5 hr.

In the phase of adding the thickener supplement (S40), the dewatered solution is cooled and thus gelled, thereby forming a uniform microstructure in the dispersed solution. While the solution cools, at least one of polypropylene and ceresin is added.

Specifically, in the present disclosure, polypropylene, which is provided in the form of a powder, has a melting point of 130 to 140° C. and a size of 0.1 μm to 1 μm. The same kind of base oil contained in the reaction solution is added with polypropylene and then stirred to prepare a polypropylene solution. Thereafter, when the temperature of the cooled solution is 140 to 160° C., the polypropylene solution prepared above is added thereto.

Also, in the present disclosure, ceresin, which is provided in the form of a powder, has a melting point of 60 to 65° C. and a size of 0.1 μm to 1 μm. When the temperature of the solution added with the polypropylene solution is 75 to 95° C., ceresin prepared above is added thereto.

When stirring (S50), the soap component of the gelled solution is uniformly dispersed, whereby the size and length of soap fibers are made constant. Here, in order to adjust consistency, a colloid mill, a three-roll mill or a homogenizer may be used, but the present invention is not limited thereto.

A better understanding of the present disclosure will be given through the following examples, which are merely set forth to illustrate the present disclosure and are not to be construed as limiting the scope of the present disclosure.

Example 1

Polyalphaolefin (PAO) having a viscosity of 50 to 400 cSt at 40° C. was prepared as a base oil and heated to 80° C. Thereafter, 12-hydroxystearic acid, serving as a main acid, and azelaic acid, lauric acid, myristic acid, sebacic acid, or palmitic acid, serving as a sub acid, were dissolved in the heated base oil, after which a metal compound Li-hydroxide was added thereto, and saponification was carried out while the temperature was elevated to 80-90° C. The reacted solution was then dewatered by heating and stirring at 180° C. for 1.5 hr. The dewatered solution was then cooled and thus gelled. Here, at least one of polypropylene and ceresin as a thickener supplement was added to the cooled solution in the specific temperature range. Specifically, 1.9 to 4.5 g (based on 100 g of the total weight) of polypropylene (having a melting point of 130 to 140° C. and a size of 1 μm)

was dissolved in polyalphaolefin (PAO) (having a viscosity of 50 to 400 cSt at 40° C.) at 150° C. and then stirred to prepare a polypropylene solution, after which the prepared polypropylene solution was added once the cooled solution was 150° C. Thereafter, 1.8 to 4.4 g of ceresin (having a melting point of 75 to 95° C. and a size of 1 μm) was added when the cooled solution was 80° C. Moreover, 1.5 wt % of Zn-stearate ($C_{36}H_{70}O_4Zn$) as an additive and 1.5 wt % of a Ba-based corrosion inhibitor Ba-sulfonate ($BaSO_4$) were added when ceresin was added. Thereafter, the solution added with the thickener supplement and the additive was stirred (rotated at 30 rpm using a rotator with wings on a metal central shaft) until the solution was cooled to 40° C., thereby manufacturing a lubricant composition. The amounts, in wt %, of the components contained in the lubricant composition are shown in Table 1 below.

Examples 2 to 5

Respective lubricant compositions were manufactured in the same manner using the components in the same wt % as in Example 1, with the exception of applying the different P/C ratio (falling in the range of 0.43 to 2.33).

Examples 6 and 7

Respective lubricant compositions were manufactured in the same manner as in Example 1, with the exception of changing the amounts, in wt %, of individual components (the P/C ratio was the same). The specific amounts thereof, in wt %, are shown in Table 1 below.

Comparative Examples 1 to 4

Respective lubricant compositions were manufactured in the same manner as in Example 1, with the exception of applying the different P/C ratio (falling out of the range of 0.43 to 2.33).

Comparative Examples 5 and 6

Respective lubricant compositions were manufactured in the same manner as in Example 1, with the exception of changing the amounts, in wt %, of individual components (the amount of the thickener supplement fell out of the range of 2 to 7 wt %). The specific amounts thereof, in wt %, are shown in Table 2 below.

Comparative Example 7

A lubricant composition was manufactured in the same manner as in Example 1, with the exception of changing the amounts, in wt %, of individual components (the amount of the thickener supplement was 5 wt % in the range of 2 to 7 wt %). The specific amounts thereof, in wt %, are shown in Table 2 below.

Comparative Example 8

A lubricant composition was manufactured in the same manner as in Example 1, with the exception of using simple soap, the lithium soap, as the thickener.

Comparative Example 9

A lubricant composition was manufactured in the same manner as in Example 1, with the exception of using polypropylene and ceresin having a powder size of 5 μm as the thickener supplement.

Comparative Example 10

A lubricant composition was manufactured in the same manner as in Example 1, with the exception of using polypropylene having a melting point of 160° C. or higher as the thickener supplement.

TABLE 1

| | Example | | | | | | |
|---|---|---|---|---|---|---|---|
| | 1 | 2 | 3 | 4 | 5 | 6 | 7 |
| Base oil | 80 | 80 | 80 | 80 | 80 | 60 | 90 |
| Thickener | 10 | 10 | 10 | 10 | 10 | 35 | 6 |
| Thickener supplement | 7 | 7 | 7 | 7 | 7 | 2 | 3 |
| (Polypropylene) | 0.6 | 0.7 | 0.5 | 0.4 | 0.3 | 0.6 | 0.6 |
| (Ceresin) | 0.4 | 0.3 | 0.5 | 0.6 | 0.7 | 0.4 | 0.4 |
| (P/C ratio) | 1.5 | 2.33 | 1 | 0.67 | 0.43 | 1.5 | 1.5 |
| Additive | 3 | 3 | 3 | 3 | 3 | 3 | 1 |

* Unit: wt %
* (Polypropylene) and (Ceresin) list the respective proportions when the total weight of the thickener supplement is 1.
* (P/C ratio) is the polypropylene/ceresin ratio

TABLE 2

| | Comparative Example | | | | | | |
|---|---|---|---|---|---|---|---|
| | 1 | 2 | 3 | 4 | 5 | 6 | 7 |
| Base oil | 80 | 80 | 80 | 80 | 85 | 78 | 81 |
| Thickener | 10 | 10 | 10 | 10 | 12 | 9 | 11 |
| Thickener supplement | 7 | 7 | 7 | 7 | 0 | 10 | 5 |
| (Polypropylene) | 1 | 0.9 | 0.1 | 0 | 0 | 0.6 | 0.6 |
| (Ceresin) | 0 | 0.1 | 0.9 | 1 | 0 | 0.4 | 0.4 |
| (P/C ratio) | 10 | 9 | 0.111 | 0 | — | 1.5 | 1.5 |
| Additive | 3 | 3 | 3 | 3 | 3 | 3 | 3 |

* Unit: wt %
* (Polypropylene) and (Ceresin) list the respective proportions when the total weight of the thickener supplement is 1.
* (P/C ratio) is the polypropylene/ceresin ratio

TABLE 3

| | Comparative Example | | |
|---|---|---|---|
| | 8 | 9 | 10 |
| Base oil | 80 | 80 | 80 |
| Thickener | 10 | 10 | 10 |
| Thickener supplement | 7 | 7 | 7 |
| (Polypropylene) | 0.6 | 0.6 | 0.6 |
| (Ceresin) | 0.4 | 0.4 | 0.4 |
| (P/C ratio) | 1.5 | 1.5 | 1.5 |
| Additive | 3 | 3 | 3 |

* Unit: wt %
* (Polypropylene) and (Ceresin) list their respective proportions when the total weight of the thickener supplement is 1.
* (P/C ratio) is the polypropylene/ceresin ratio Test Example (1) Test Method Measurement of High-Temperature Evaporation Amount A glass Petri dish was allowed to stand at 80° C. for 30 hr and then cooled until the surface temperature thereof reached room temperature, and the weight thereof was measured. Then, 1 g of the lubricant composition at a size of 1 cm×1 cm was thinly applied to the Petri dish at room temperature, after which the weight thereof was measured. The Petri dish was allowed to stand in a high-temperature (150° C.) chamber for 96 hr and then cooled at room temperature for 1 hr, after which the weight thereof was measured. The weight of the lubricant composition that evaporated was calculated.

Method of Measuring High-Temperature Oil Separation

Evaluation was performed in accordance with ASTM D6184 (Oil Separation from Lubricating Grease). The temperature was set to 150° C.

Method of Measuring High-Temperature Friction Coefficient

Evaluation was performed in accordance with ASTM D5707 (Test Method for Measuring Friction and Wear Properties of Lubricating Grease Using a High-Frequency, Linear-Oscillation (SRV) Test Machine). Although, the testing conditions were 150° C.×50 Hz×1 mm×1 hr×200 N.

Method of Measuring Low-Temperature Torque

Evaluation was performed in accordance with ASTM D1478 (Test Method for Low-Temperature Torque of Ball Bearing Grease).

(2) Test Results

The results from testing the evaporation amount and friction characteristics of the lubricant compositions of the Examples and Comparative Examples are shown below.

TABLE 4

| | Example | | | | | | |
|---|---|---|---|---|---|---|---|
| | 1 | 2 | 3 | 4 | 5 | 6 | 7 |
| High-temperature evaporation amount | 3% | 2% | 3% | 4% | 5% | 2.5% | 5% |
| High-temperature friction coefficient | 0.08 | 0.06 | 0.06 | 0.05 | 0.08 | 0.08 | 0.07 |
| High-temperature oil separation | 4.78% | 2.60% | 3.2% | 4.6% | 4.87% | 2.73% | 4.3% |
| Low-temperature torque | 6000 | 5200 | 4730 | 4320 | 3880 | 5900 | 3100 |

Unit = High-temperature evaporation amount: %
High-temperature friction coefficient: unitless factor
High-temperature oil separation: %
Low-temperature torque: gf · cm at −40° C.

TABLE 5

| | Comparative Example | | | | | | |
|---|---|---|---|---|---|---|---|
| | 1 | 2 | 3 | 4 | 5 | 6 | 7 |
| High-temperature evaporation amount | 9% | 8% | 10% | 12% | 9% | 6% | 3% |
| High-temperature friction coefficient | 0.12 | 0.09 | 0.11 | 0.12 | 0.12 | 0.13 | 0.05 |
| High-temperature oil separation | 10% | 8.60% | 11.3% | 14% | 15% | 7% | 3.67% |
| Low-temperature torque | 10000 | 9600 | 3150 | 2100 | 1730 | 8700 | 4760 |

Unit = High-temperature evaporation amount: %
High-temperature friction coefficient: unitless factor
High-temperature oil separation: %
Low-temperature torque: gf · cm at −40° C.

TABLE 6

| | Comparative Example | | |
|---|---|---|---|
| | 8 | 9 | 10 |
| High-temperature evaporation amount | 14% | 7% | 8% |
| High-temperature friction coefficient | 0.12 | 0.13 | 0.13 |
| High-temperature oil separation | 16% | 7.60% | 11% |
| Low-temperature torque | 4800 | 9,600 | 6,700 |
| Note | — | Agglomeration | Agglomeration |

Unit = High-temperature evaporation amount: %
High-temperature friction coefficient: unitless factor
High-temperature oil separation: %
Low-temperature torque: gf · cm at −40° C.

As is apparent from Table 4, according to one form of the present disclosure, when the lubricant composition includes 60 to 90 wt % of the base oil, 5 to 35 wt % of the thickener, 2 to 7 wt % of the thickener supplement with a polypropylene/ceresin ratio (P/C ratio) of 0.43 to 2.33, it results in a high-temperature evaporation amount of less than 5%, a high-temperature friction coefficient of less than 0.1, high-temperature oil separation of less than 5%, and a low-temperature torque of less than 6000. In other words, according to one form of the present disclosure, the lubricant composition was confirmed to have a low evaporation amount with friction characteristics that could be maintained at high temperatures, thus effectively improving lubricant composition's performance at high-temperature, preventing sticking phenomenon, and reducing oil contamination, thereby ultimately increasing durability when applied to parts such as powertrains and the like.

On the other hand, by using Table 5 to compare Comparative Examples 1 to 4 with Examples 1 to 7, despite the Comparative Examples' components using the same wt % as Examples 1 to 7, when the P/C ratio fell outside the range of 0.43 to 2.33, it resulted in a high-temperature evaporation amount of 9% or more, a high-temperature friction coefficient of 0.1 or more, high-temperature oil separation of 10% or more, and a low-temperature torque of 6000 or more. In other words, it was confirmed that the lubricant composition manufactured at a P/C ratio falling out of the range of 0.43 to 2.33 would lead to high evaporation amount and difficulty in maintaining the friction characteristics at high temperatures, and, as a result, sticking and oil contamination may occur, making it impossible to increase durability when applied to parts such as powertrains and the like.

Furthermore, as is apparent from Table 5, in Comparative Examples 5 and 6 (which had the same P/C ratio as in Example 1 but a different amount of the thickener supplement falling outside the range of 2 to 7 wt %), a high-temperature evaporation amount of 9% or more, a high-temperature friction coefficient of 0.1 or more, and high-temperature oil separation of 10% or more resulted. Thus, even if the P/C ratio falls within the range of 0.43 to 2.33 if the amount of the thickener supplement falls outside the range of 2 to 7 wt %, it was confirmed that the evaporation amount is high and friction characteristics cannot be maintained at high temperatures, making it impossible to increase durability.

In the case of Comparative Example 7 (in which the P/C ratio was the same as in Example 1 and the amount of the thickener supplement fell in the range of 2 to 7 wt %), a high-temperature evaporation amount of less than 5%, a high-temperature friction coefficient of less than 0.1, high-temperature oil separation of less than 5%, and a low-temperature torque of less than 6000 resulted.

As is apparent from Table 6, in Comparative Example 8 (in which simple soap, namely lithium soap, was used as the thickener), Comparative Example 9 (in which polypropylene and ceresin with a powder size of 5 μm were used as the thickener supplement) and Comparative Example 10 (in which polypropylene with a melting point of 160° C. or higher was used as the thickener supplement), a high-temperature evaporation amount of 9% or more, a high-temperature friction coefficient of 0.1 or more, and high-temperature oil separation of 10% or more resulted. Particularly, in Comparative Examples 9 and 10, agglomeration even occurred. Thus, if the thickener is not a complex soap, the powder size exceeds 1 μm, or the melting point of polypropylene does not satisfy 130 to 140° C., it can be confirmed that the evaporation amount is high and friction characteristics cannot be maintained at high temperatures, making it impossible to increase durability when applied to parts such as powertrains and the like.

Although specific forms of the present disclosure have been described with reference to the accompanying drawings, those skilled in the art will appreciate that the present disclosure may be embodied in other specific forms without changing the technical spirit or desired features thereof. Thus, the forms described above should be understood to be non-limiting and illustrative in every way.

What is claimed is:

1. A method of manufacturing a lubricant composition, the method comprising:

heating a base oil;

obtaining a solution by adding and reacting the heated base oil with a thickener;

dewatering the reacted solution;

adding a thickener supplement to the dewatered solution; and stirring the dewatered solution added with the thickener supplement, wherein the lubricant composition comprises:

60 to 90 wt % of the base oil;

5 to 35 wt % of the thickener; and 2 to 7 wt % of the thickener supplement, wherein adding the thickener supplement to the dewatered solution includes adding polypropylene and ceresin during cooling of the dewatered solution, and wherein the thickener supplement is configured such that a polypropylene/ceresin ratio (P/C ratio) is 0.40 to 2.35.

2. The method of claim 1, wherein obtaining the solution by adding and reacting the heated base oil with the thickener comprises:

obtaining a solution by dissolving at least one of a main acid or a sub acid in the heated base oil; and adding a metal compound to the solution and heating the solution, wherein the sub acid is at least one of azelaic acid, lauric acid, myristic acid, sebacic acid or palmitic acid.

3. The method of claim 2, wherein the metal compound is at least one of Li-hydroxide or Ca-hydroxide.

4. The method of claim 1, wherein adding the thickener supplement to the dewatered solution includes dissolving polypropylene in the base oil at 140 to 160° C. and stirred to afford a polypropylene solution, which is then added to during cooling of the dewatered solution.

5. The method of claim 4, wherein when a temperature of the dewatered solution is 140 to 160° C., the polypropylene solution is added.

6. The method of claim 1, wherein when a temperature of the dewatered solution is 75 to 95° C., the ceresin is added.

7. The method of claim 6, wherein an additive is further added when the ceresin is added.

* * * * *